US006470964B1

(12) United States Patent
Nakado et al.

(10) Patent No.: US 6,470,964 B1
(45) Date of Patent: Oct. 29, 2002

(54) HEAT EXCHANGER TUBE

(75) Inventors: Koji Nakado; Masashi Inoue, both of Nishi-kasugai-gun (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/668,342

(22) Filed: Sep. 25, 2000

(30) Foreign Application Priority Data

Jan. 21, 2000 (JP) ..... 2000-013400

(51) Int. Cl.[7] ..... F28F 19/02; F28F 1/14

(52) U.S. Cl. ..... 165/177; 165/183; 165/133

(58) Field of Search ..... 165/177, 183, 165/133; 29/890.053, 890.049; 138/37, 38, 42

(56) References Cited

U.S. PATENT DOCUMENTS 2,912,749 A * 11/1959 Bauernfeind et al. .. 29/890.039
4,570,700 A * 2/1986 Ohara et al. ..... 165/177
5,186,250 A * 2/1993 Ouchi et al. ..... 165/177
5,441,105 A * 8/1995 Brummett et al. ..... 165/177
5,560,425 A * 10/1996 Sugawara et al. ..... 165/173
5,768,782 A * 6/1998 Kato ..... 29/890.053
5,826,646 A * 10/1998 Bae et al. ..... 165/183

FOREIGN PATENT DOCUMENTS

JP 59-13877 1/1984
JP 0084255 A * 3/1990 ..... 228/183
JP 9-329397 12/1997

* cited by examiner

*Primary Examiner*—Henry Bennett
*Assistant Examiner*—Tho V Duong
(74) *Attorney, Agent, or Firm*—Oblon, Spivak, McClelland, Maier & Neustadt, P.C.

(57) ABSTRACT

A heat exchanger tube, which has a high pressure resistance, includes a tube body, wherein the interior of the tube body defines a fluid flow passage. The inner and outer surfaces of the tube body of the heat exchanger tube defines heat entrance and exit surfaces for the fluid. The tube body of the heat exchange tube has first and second wall portions which are opposed to each other. Either the first wall porition has a plurality of bowl-shaped bulging wall portions which bulge toward the direction of the second wall portion to fixedly meet the second wall portion or else both the first and second wall portion both have a plurality of bowl-shaped bulging wall portions which are correspondingly located so that a bulging leading end of a bowl-shaped bulging wall portion in a first wall portion bulges toward and fixedly meets a bulging leading end of a bowl-shaped bulging wall portion in the second wall portion which bulges toward the first wall portion.

15 Claims, 5 Drawing Sheets

HEAT EXCHANGER TUBE

CROSS-REFERENCE TO RELATED APPLICATIONS

This application is related to and claims priority, under 35 U.S.C. §119, from Japanese Patent Application No. 2000-013400, filed on Jan. 21, 2000, the entire contents of which are hereby incorporated by reference herein.

BACKGROUND OF THE INVENTION

1. Field of the Invention

The present invention relates to a heat exchanger tube preferably used for a heat exchanger tube for a cooling medium or the like which constitutes a condenser of an air conditioner or a refrigerator.

This application is based on Japanese Patent Application No. 2000-13400, the contents of which are incorporated herein by reference.

2. Discussion of Background

In a cooling device such as an air conditioner or a refrigerator or the like, a cooling medium (fluid) of Freon or the like is first compressed to form a high temperature and high pressure gas and is then liquefied by cooling the gas with a condenser. In the condenser is incorporated a heat exchanger tube through which a cooling medium flows, and a high temperature and high pressure gaseous cooling medium is gradually cooled by heat dissipation while passing through the tube so that it is condensed into a liquid. As this kind of heat exchanger tubes, a heat exchanger tube shown in FIG. 10 or the like has been known. A tube body 7 is constituted by a solder material-cladded band-shaped metallic plate member 1 being folded or bent with a fold 2 in a direction of its extension, connecting end portions 5, 5, which are mutually brought into contact with end portions of one wall portion 3 and the other wall portion 4 folded and extended in the same direction, are formed and are welded thereto, and a cooling medium passage 6 is formed between these wall portions.

Further, the curvature radius of the fold 2 is smaller than the width of the wall portion 3 or 4, and the distance between the wall portions 3 and 4 is smaller than the width of the wall portion 3 or 4. This shape is defined to reduce the time required for heat dissipation by decreasing the distance from the center of the tube body 7 to the wall portion.

The thus formed interior defines a cooling medium passage 6. A plurality of bulging wall portions 8, 8 . . . bulging in a bowl shape toward a direction of the opposite wall portions are formed on both opposite wall portions 3 and 4 of the tube body 7 in which the inner surface and the outer surface are defined as the heat entrance and exit surfaces for the cooling medium, and bulging leading ends of the bulging wall portions 8, 8 . . . are defined as connecting portions 9, 9 . . . The connecting portions 9, 9 . . . are brought into contact with opposite bulging wall portions in a plane and are welded by soldering. A cooling medium that flows in the interior of the tube is caused to generate a turbulent flow by these bulging wall portions 8, 8 . . . and is uniformly agitated within the tube body so that the temperature distribution of a fluid in a plane vertical to the flow is made uniform. Further, the opposite wall portions 3 and 4 are connected to each other by the plurality of welded bulging wall portions 8, 8 . . . and are supported against a pressure applied to the wall portions 3 and 4 of the flat tube body 7 when a high pressure cooling medium flows in the tube, thereby enhancing the pressure resistance of the tube body 7.

However, the above-mentioned conventional heat exchanger tube has the following problems.

Since the tube body is formed by folding a band-shaped metallic plate member with a fold, it tends to be deformed by an effect of the spring back at the fold, that is, the restoration of the bent portions, in such a manner that the opposite wall portions are separated from each other.

On the other hand, the opposite cooling medium agitating bulging portions bulging in bowl shapes are soldered in a plane at the connecting portions brought into contact with each other. However, when an oxide film formed on the surface of a solder material has been separated for soldering with flux, the bulging portion has a structure making discharge of the separated oxide film from the outer periphery of the surface-shaped connecting portion difficult. Thus, it is actually difficult to solder at the center of the connecting portion.

Therefore, in addition to the circumstances of difficult soldering, when a force which separates the opposite wall portions by the spring back is applied to the tube body, firm welding is not performed at the connecting portion between the bulging wall portion leading ends. As a result, the tube body has no support against the pressure of the cooling medium, whereby the pressure resistance of the tube body deteriorates.

SUMMARY OF THE INVENTION

The present invention was made in consideration of the above-mentioned circumstances. The object of the present invention is to provide a heat exchanger tube having an improved soldering process and high pressure resistance by forming a structure which easily discharges an oxide film separated with flux, and prevents the deformation of the tube body due to the spring back effect.

A first aspect of the invention relates to a heat exchanger tube having the tube body whose interior is defined as a passage of a fluid and whose inner and outer surfaces are defined as heat entrance and exit surfaces of the fluid and is characterized in that a bulging wall portion bulging toward a direction of opposite wall portions is formed on one or both of the opposite wall portions of said tube body, the bulging leading ends of said bulging wall portions are defined as connecting portions linearly protruding and said connecting portions are linearly brought into contact with the opposite wall portions and are fixed thereto.

By providing such a configuration, a soldering material oxide separated with flux at the connecting portion of the leading end of the bulging wall portion flows out of a linear connecting portion whereby soldering is improved and the opposite wall portions are firmly soldered without occurrence of a weld failure.

A second aspect of the invention relates to a heat exchanger tube, and is characterized in that it provides a first bulging wall portion bulging in a bowl shape in a direction of wall portions opposite to said bulging wall portion, with a plurality of said first bulging wall portions being formed on said tube body.

By providing such a configuration, the opposite wall portions are connected to each other at a plurality of positions by a plurality of first bulging wall portions. Further, a fluid flowing in the interior of the tube generates a turbulence flow with the plurality of first bulging wall portions and is uniformly agitated in the tube body.

A third aspect of the invention relates to a heat exchanger tube, and is characterized in that a plurality of protrusions with triangular sections protruding linearly in the direction of the extension of the tube body are formed on the inner surface of said tube body in such a manner that they are adjacent to each other, said protrusions being defined as said connecting portions.

By providing such a configuration, positions which are linearly soldered are increased at the connecting portions of the leading ends of the first bulging wall portions where opposite wall portions are connected to each other. Thus, the opposite wall portions are firmly connected to each other.

Further, since the surface area of the inner surface of the tube body defined as the heat entrance or exit surface is increased, a contact area with the fluid is increased.

A fourth aspect of the invention relates to a heat exchanger tube, and is characterized in that it provides a second bulging wall portion including a first extending portion extending toward the direction of wall portions opposite from one reference position of the wall portion to serve as said bulging wall portion, a return portion which is folded back from said first extending portion to the direction of said reference position and a second extending portion which is folded back from the return portion to said one reference position of the wall portion.

By providing such a configuration the folded portion of the second bulging wall portion and the opposite wall portions are linearly brought into contact with each other in a direction of the extension of the tube body, a soldering length is increased and the soldering material oxide separated from flux speedily flows out of the linear connecting portion whereby soldering can be improved. Thus, the opposite wall portions are firmly connected to each other.

A fifth aspect of the invention relates to a heat exchanger tube, and is characterized in that said tube body is formed by a band-shaped plate member extending in one direction, said plate member is defined as said one wall portion in the intermediate portion of the plate member in the width direction and is folded with two folds in a direction of the extension of the tube body in both end portions of said one wall portion, said folded portions are extended to each other in an adjacent direction to form the other wall portion, said folded portion is further folded in a direction of said one wall portion at a contact position and is extended toward the same direction of said one wall portion to form a third extending portion, the end portion of said third extending portion being brought into contact with said other wall portion and being fixed thereto.

By providing such a configuration the end portion of the third bulging wall portion and the other wall portion are linearly brought into contact with each other in a direction of the extension of the tube body, the soldering length is increased, and the soldering material oxide separated from flux speedily flows out of the linear connecting portion whereby soldering can be improved. Thus, the opposite wall portions are firmly connected to each other.

Further, since the weld surface in the third extending portion composed of a mutual contact portion is pressed from both sides by the pressure of a fluid flowing in the passage to be press bonded, the pressure resistance is enhanced.

A sixth aspect of the invention relates to a heat exchanger tube, and is characterized in that an opening portion for allowing the fluid passages partitioned with said third extending portion to communicate with each other is formed in said third extending portion.

By providing such a configuration a fluid flowing through the tube body is passed between the passages of a fluid divided with the third extending portion, whereby it flows through the entire interior of the tube body.

A seventh aspect of the invention relates to a heat exchanger tube, and is characterized in that said tube body comprises a pair of plate members extending in the direction of the extension of said tube body, the plate members are formed so that the passage for said fluid is formed between the plate members, and the plate members have connected end portions overhanging on each side, on both respective end portions, the respective connected end portions of these plate members being brought into contact with each other and being fixed thereto.

By providing such a configuration, both the wall portions of the tube body are formed with a pair of band-shaped plate members. Thus, to form both wall portions it is not necessary to fold a band-shaped plate member by 180 degrees with a fold in a direction of the extension of the plate member. The spring back is increased with the magnitude of the bending angle. Accordingly, a bending angle required for forming the tube body is decreased and a force which acts on the wall portion by the spring back is decreased.

A eighth aspect of the invention relates to a heat exchanger tube, and is characterized in that said connecting end portion is fastened with a U-shaped folded fastening plate member.

By providing such a configuration the connecting portions which are brought into contact with each other in a plane and are soldered therewith are externally reinforced with a fastening plate member, and a force due to the spring back applied to the weld surface or a force due to the fluid pressure is reduced.

A ninth aspect of the invention relates to a heat exchanger tube having the tube body whose interior is defined as a passage for a fluid and whose inner and outer surfaces are defined as heat entrance and exit surfaces for the fluid and is characterized in that in said tube body a band-shaped plate member is folded with a fold in the direction of the extension of the plate member, a passage of said fluid is formed between one wall portion and the other wall portion extending in the same direction by the folding, a plurality of spring back preventing portions where said one and the other wall portions are brought into contact with each other and are fixed in said folded portion is formed, connecting end portions brought into contact with each other are formed on the end portions of said one and the other wall portions, and said connecting end portions are fixed.

By providing such a configuration a force which causes the tube body to deform by the spring back is locally acted on the spring back preventing portion and the magnitude of the force of separating opposite wall portions is reduced.

BRIEF DESCRIPTION OF THE DRAWING FIGURES

DETAILED DESCRIPTION OF THE PREFERRED EMBODIMENTS

First to fourth embodiments of a heat exchanger tube according to the present invention will now be described with reference to drawings.

First Embodiment

Figure 1:
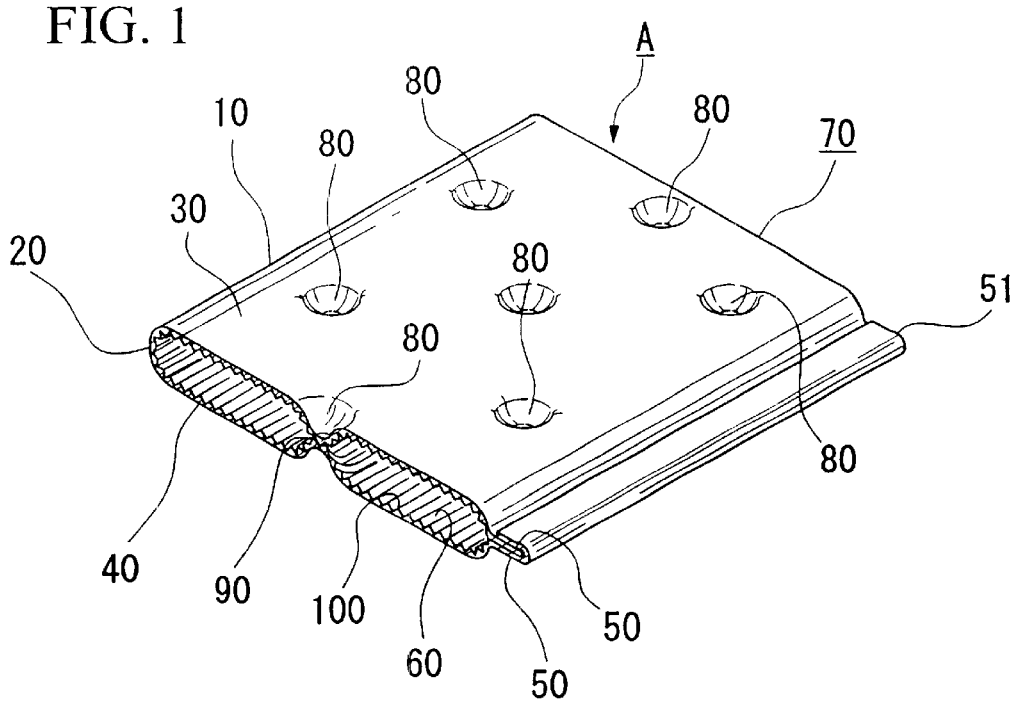
FIG. 1 is a view showing a first embodiment of the present invention that is a perspective view showing one example of a heat exchanger tube.

A first embodiment of a heat exchanger tube according to the present invention is shown in FIG. 1. In a heat exchanger tube A shown in FIG. 1, a tube body 70 is configured in such a manner that a soldering material-cladded band-shaped metallic plate member 10 is folded with a fold 20 in a direction of the extension of the plate member, connecting portions 50, 50, which are brought into contact with each other, are formed at end portions of one wall portion 30 and the other wall portion 40 extending in the same direction by the folding and then are welded (fixed) by soldering to form a cooling medium passage 60 between these wall portions. Further, the connecting portions 50, 50 welded by soldering are fastened and fixed with a U-shaped folded fastening plate member 51 formed by the extension of the one connecting end portion 50.

Such an interior of the tube body 70 defines the cooling medium passage 60. A plurality of bowl-shaped bulging wall portions (first bulging wall portions) 80, 80 . . . bulging toward the direction of the opposite wall portions in bowl-shapes are formed on both opposite wall portions 30 and 40 of the tube body 70, the inner surface and the outer surface of the wall portion being defined as the heat entrance and exit surfaces for the fluid.

On the inner surface of the tube body 70 are formed adjacently to each other with triangle-shaped cross-sections with a sharp vertical angle a plurality of protrusion members 100, 100 . . . linearly extending in a direction of the extension of the tube body 70, which is smaller than the bowl-shaped bulging wall portions 80, 80 . . . , and the protrusion members 100, 100 . . . are defined as connecting portions 90, 90 . . . at the bulging leading ends of the bowl-shaped bulging wall portions 80, 80 . . . Opposite bowl-shaped bulging portions 80, 80 are linearly brought into contact with each other by the protrusion members 100, 100 at these connecting portions 90, 90 to be soldered to each other.

In the heat exchanger tube A having this configuration, oxides of the soldering material separated by flux speedily flow out of the linear contact portions of the plurality of protrusion members 100, 100 . . . at the leading end connecting portions 90, 90 of the bowl-shaped bulging wall portions 80, 80 so as to allow improved soldering. Accordingly, the opposite wall portions 30 and 40 can be connected to each other without occurrence of weld failures. Further, the opposite wall portions 30 and 40 are further firmly connected to each other at positions by the plurality of the bowl-shaped bulging wall portions 80, 80 . . .

Furthermore, a fluid flowing in the passage 60 generates turbulence flows at the plurality of the bowl-shaped bulging wall portions 80, 80 . . . Thus, the fluid is uniformly agitated in the tube body 70.

According to the heat exchanger tube A shown in FIG. 1, superior soldering is carried out at the leading end connecting portions 90 and 90 of the bowl-shaped bulging wall portions 80, 80 . . . , which connects opposite wall portions 30 and 40 to each other, so that strong weld is obtained. Further, by providing these bowl-shaped bulging wall portions 80, 80 . . . at a plurality of positions, the opposite wall portions 30 and 40 are further firmly connected to each other by a high pressure resistance that is imparted to the tube body.

Further, the connecting end portion is externally fixed with the fastening plate member 51, and a deformation of the tube body due to the spring back is prevented so that the welding is easily carried out, and after the formation of the tube body, a force due to the flow pressure applied to the connecting end portion is decreased so that a high pressure resistance is imparted to the tube body.

Further, since the fluid is agitated, a temperature of the fluid in a plane vertical to the flow can be made uniform. Additionally, since the surface area of the inner surface is increased by the plurality of protrusion members 100, 100 . . . , the contact surface area between the fluid and the tube body is increased and the thermal conductivity from the fluid to the tube body can be improved.

Figure 2:
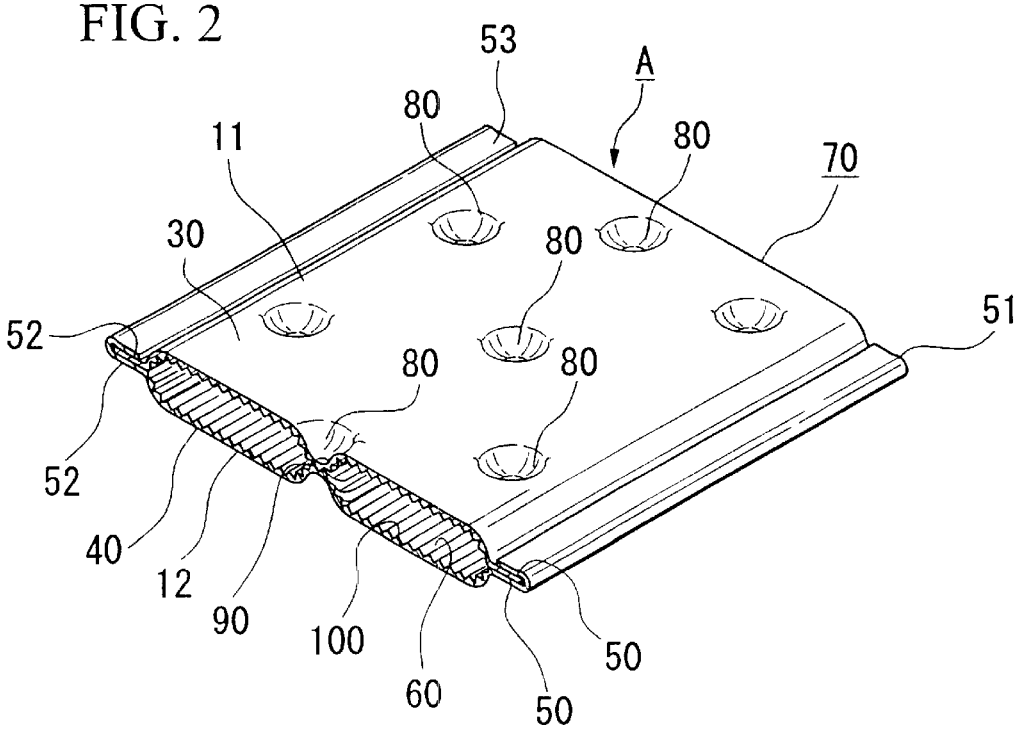
FIG. 2 is a view showing a first embodiment of the present invention that is a perspective view showing another example (first example) of a heat exchanger tube.

Alternatively, as shown in FIG. 2, the heat exchanger tube A may be configured so that it is composed of a pair of band-shaped plate members 11 and 12 extending in the direction of the extension of the tube body 70, a passage 60 of the fluid is formed between these plate members 11 and 12, the heat exchanger tube A is formed so as to have connecting portions 50, 50 and 52, 52 extending to the sides at the respective both end portions, the respective connecting portions of these plate members are welded and fastened to each other by U-shaped folded fastening plate members 51 and 53 respectively.

In the heat exchanger tube A having said configuration, one wall portion 30 and the other wall portion 40 of the tube body are formed by a pair of band-shaped plate members 11 and 12. Therefore, to form the both wall portions 30 and 40 it is not necessary to fold one band-shaped plate member by 180 degrees with a fold in a direction of the extension of the plate member. The spring back is increased with the increase of the bending angle. Thus, by reducing the bending angle required for the formation of the tube body the force which acts on the wall portion by the spring back is also reduced.

Further, connections at the connecting end portions are reinforced with the fastening plate members 51 and 53 and the force applied to the soldered or welded surface of the connecting end portion due to the fluid pressure is reduced.

As described above, according to the heat exchanger tube A shown in FIG. 2, effects due to the spring back are reduced. Accordingly, reliable soldering can be performed while maintaining the shape of the tube body, and a higher pressure resistance can be imparted to the tube body.

Second Embodiment

Figure 3:
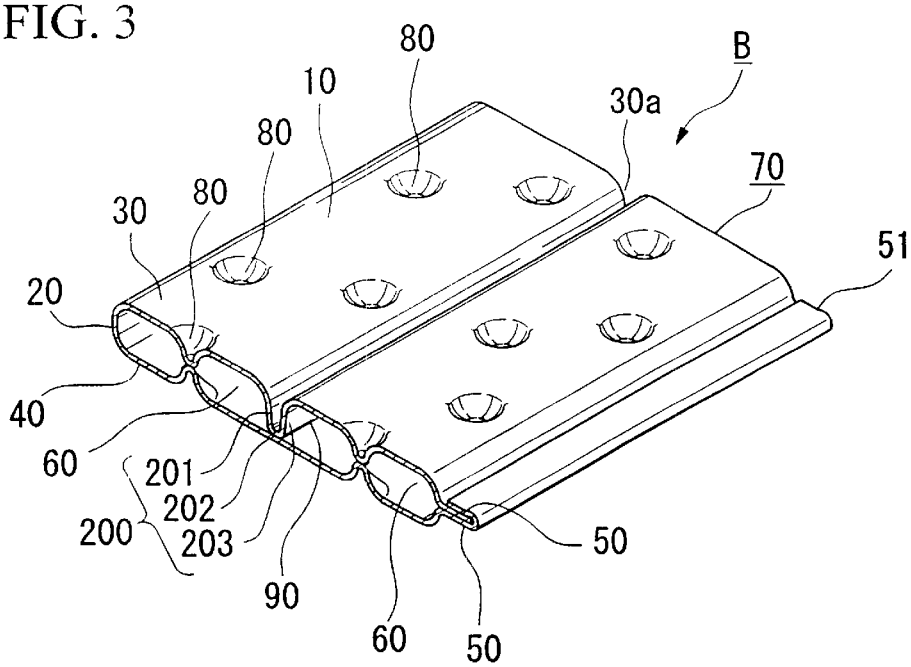
FIG. 3 is a view showing a second embodiment of the present invention that is a perspective view showing one example of a heat exchanger tube.

FIG. 3 shows a second embodiment of a heat exchanger tube according to the present invention. A heat exchanger tube B shown in FIG. 3 includes a wedge-shaped bulging wall portion 200 (second bulging wall portion) composed of an extending portion 201 (first extending portion) extending from the wall portion reference position 30*a* (one wall portion reference position) of the wall portion 30 to the direction of the opposite wall portion 40, a folded portion 202 folded from the extending portion 201 to the reference position and an extending portion 203 (second extending portion) which is folded back from the folded portion 202 to the wall portion reference position 30*a*.

Further, the folded portion 202 of the wedge-shaped bulging wall portion 200 and the opposite wall portion 40 are linearly brought into contact with each other in the direction of the extension of the tube body 70, and the leading end (bulging end) of the folded portion 202 of the wedge-shaped bulging wall portion 200 defines a connecting portion 90 and is welded to each other by soldering.

In the heat exchanger tube B shown in FIG. 3 portions corresponding to the portions shown in FIGS. 1 and 2 respectively are denoted by the same reference numerals and the details thereof are omitted.

Thus, in the heat exchanger tube B having the above-mentioned configuration, the length of the soldered portion in a direction of the extension of the tube body 70 is increased and soldering material oxides separated by flux speedily flow out of the linear connecting portion to obtain better soldering. Accordingly, the weld is strengthened so that the opposite wall portions are firmly connected to each other.

According to the heat exchanger tube B shown in FIG. 3, the opposite wall portions 30 and 40 are firmly connected to each other and a high pressure resistance can be imparted to the tube body.

Figure 4:
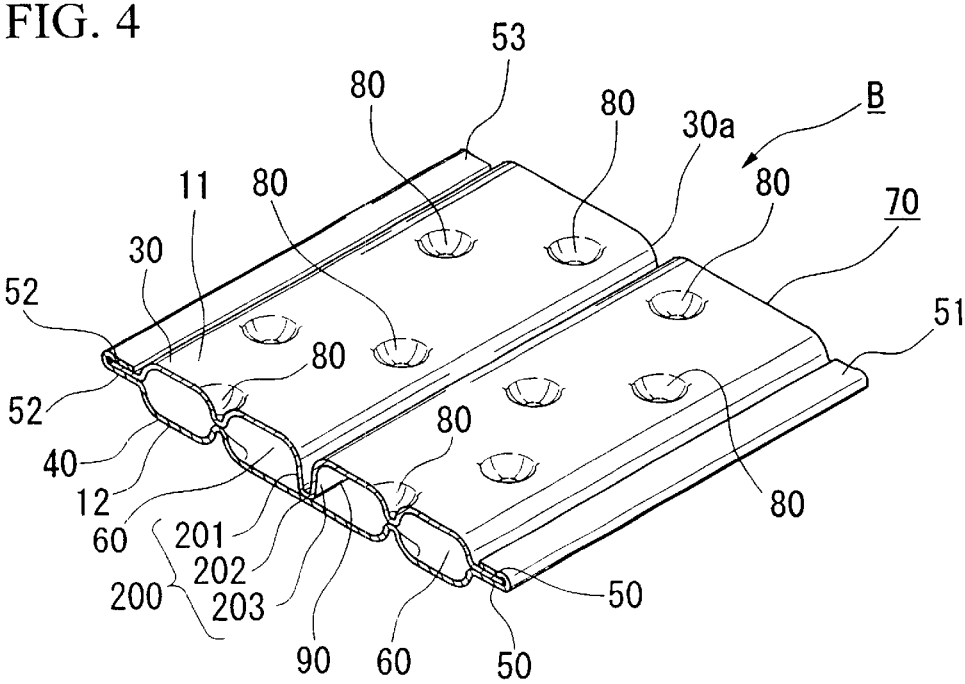
FIG. 4 is a view showing a second embodiment of the present invention that is a perspective view showing another example (first example) of a heat exchanger tube.

Alternatively, as shown in FIG. 4, the heat exchanger tube B may be configured so that it is composed of a pair of band-shaped plate members 11 and 12 extending in the direction of the extension of the tube body 70, a passage 60 for the fluid is formed between these plate members 11 and 12, the exchanger tube B is formed so as to have connecting portions 50, 50 and 52, 52 extending to the sides at the both respective end portions, the both respective connecting portions of these plate members are welded to each other and fastened to each other with U-shaped folded fastening plate members 51 and 53 respectively.

In the heat exchanger tube B having said configuration, one wall portion 30 of the tube body and the other wall portion 40 thereof are formed by a pair of band-shaped plate members 11 and 12. Therefore, to form both wall portions 30 and 40, it is not necessary to fold one band-shaped plate member by 180 degrees with a fold in a direction of the extension of the plate member. The spring back is increased with the increase of the bending angle. Thus, by reducing the bending angle required for the formation of the tube body, the force which acts on the wall portion by the spring back is also reduced.

Further, the fastening plate members 51 and 53 strengthen the connection at the connecting end portions, thereby reducing a force applied by the fluid pressure onto the welded surface of the connecting end portions.

According to the heat exchanger tube B shown in FIG. 4, the effects due to the spring back are reduced. Accordingly, reliable soldering can be performed while maintaining the shape of the tube body, and a higher pressure resistance can be imparted to the tube body.

Figure 5:
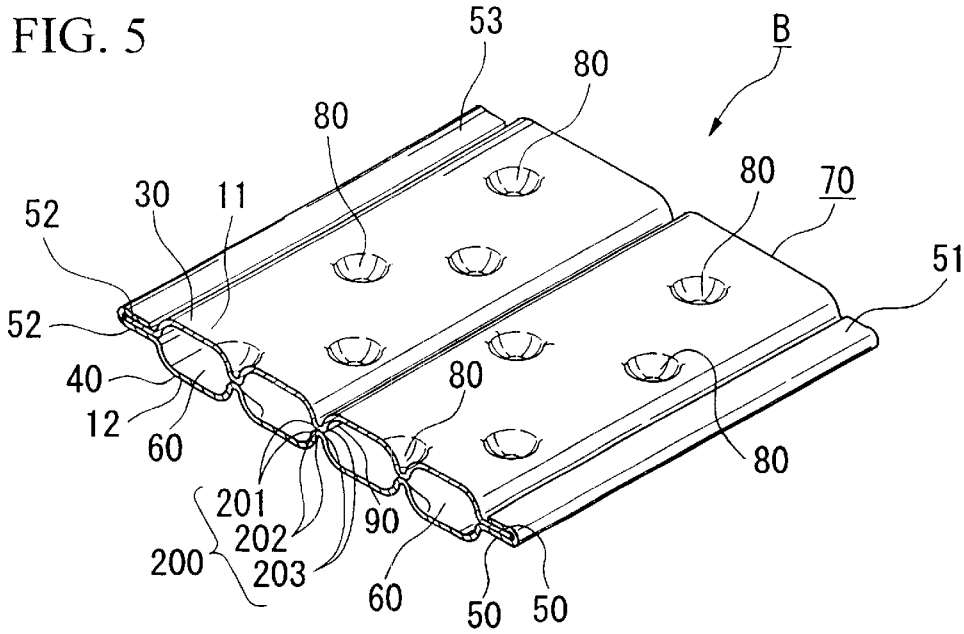
FIG. 5 is a view showing a second embodiment of the present invention that is a perspective view showing another example (second example) of a heat exchanger tube.
Figure 6:
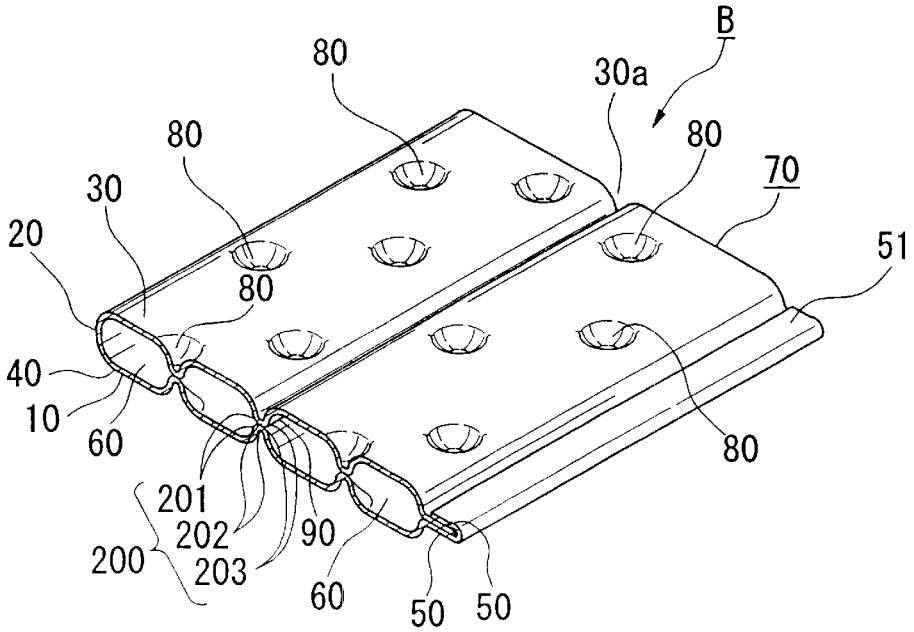
FIG. 6 is a view showing a second embodiment of the present invention that is a perspective view showing another example (third example) of a heat exchanger tube.

Alternatively, as shown in FIGS. 5 and 6, a heat exchanger tube B may be formed by a band-shaped plate member 10 or a pair of band-shaped plate members 11 and 12, wedge-shaped bulging wall portions 200, 200 are provided on both sides of opposite wall portions 30 and 40, and the leading ends (bulging leading ends) of these wedge-shaped bulging wall portions 200, 200 are linearly brought into contact with each other in a direction of the extension of the tube body 70 at the respective folded portions 202, 202 to form a connecting portion 90 and are welded by soldering.

Alternatively, although each of the heat exchanger tubes shown in FIGS. 3 to 6 has a configurations provided with a single wedge-shaped bulging wall portion, they may have a plurality of bulging wall portions.

Third Embodiment

Figure 7:
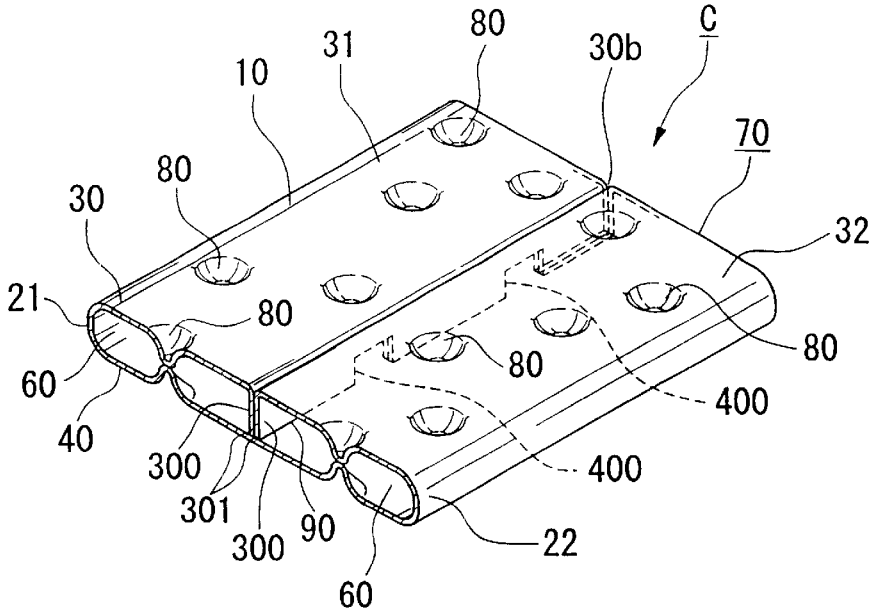
FIG. 7 is a view showing a third embodiment of the present invention that is a perspective view showing one example of a heat exchanger tube.

FIG. 7 shows a third embodiment of a heat exchanger tube according to the present invention. A heat exchanger tube C shown in FIG. 7 is formed with a band-shaped plate member 10 extending in one direction. The plate member 10 is defined as a wall portion 40 in the intermediate portion in the width direction of the plate member 10 and is folded with two folds 21 and 22 in the direction of the extension of the tube body 70 at both the ends of the wall portion 40. The folded portions 31 and 32 are extended in their closing directions to form the other wall portion 30. Further, the portions 31 and 32 are bent in the direction of the wall portion 40 at the contact position 30*b* and are extended in the direction of the wall portion 40 to form extending portions 300, 300 (third extending portions). The end portions 301, 301 of the extending portions 300, 300 are brought into linear contact with the wall portion 40 in a direction of the extension of the body tube 70 to be welded to each other by soldering, and serves as a connecting portion 90.

In the heat exchanger tube C shown in FIG. 7, portions corresponding to the portions shown in FIGS. 1 to 6 respectively are denoted by the same reference numerals and the details thereof are omitted.

Thus, in the heat exchanger tube C having the above-mentioned configuration, the length of the soldered portion in a direction of the extension of the tube body 70 is increased and soldering material oxides separated by flux speedily flow out of the linear connecting portion to obtain better soldering. Accordingly, the weld is strengthened so that the opposite wall portions are firmly connected to each other.

Further, the weld surfaces in the extending portions 300, 300 brought into contact with each other are pressed from both sides by the pressure of fluid flowing in the passage 60, 60, and a pressure resistance is enhanced.

According to the heat exchanger tube C shown in FIG. 7, both end portions of the band-shaped plate member are directly used as bulging wall portions. Therefore, a simple configuration can be obtained without the need to provide a new bulging wall portion, and since the seam of the plate member at the connecting portion is welded to the tube body, the pressure resistance can be enhanced.

Thus, by the welding of the extending portions 300, 300 at the connecting portion 90 separation of the opposite wall portions 30 and 40 is prevented and a high pressure resistance can be imparted to the tube body.

Figure 8:
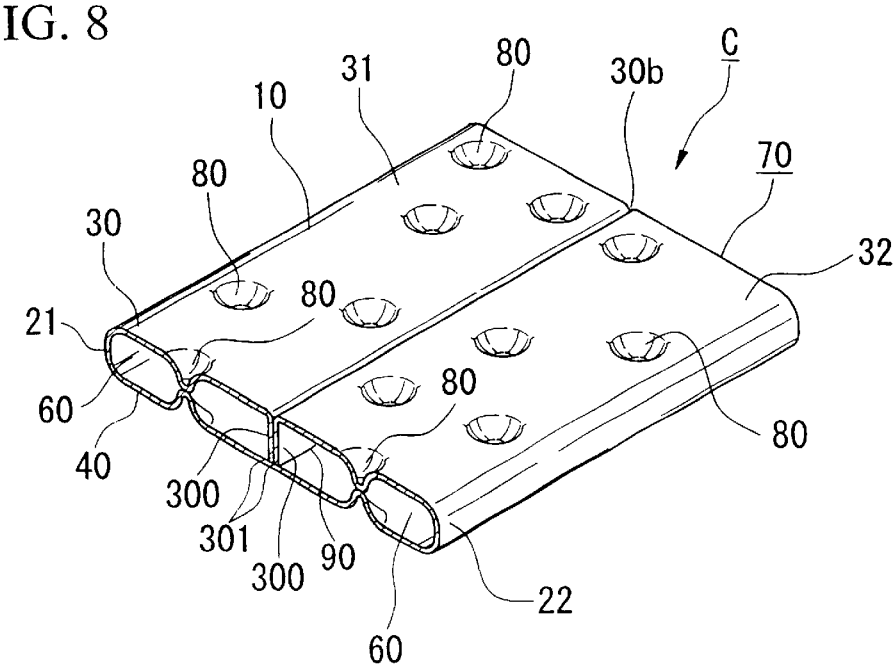
FIG. 8 is a view showing a third embodiment of the present invention that is a perspective view showing another example (first example) of a heat exchanger tube.

Alternatively, in the heat exchanger tube C, openings 400, 400 . . . which are allowed to lead to fluid passages 60, 60 divided with the extending portions 300, 300 may be formed in the extending portions 300, 300, as shown in FIG. 8.

According to the heat exchanger tube C shown in FIG. 8, a fluid flows through the entire interior of the tube body 70. Thus, the difference between temperatures of the fluid do not occur between the passages 60, 60 divided with the extending portions 300, 300.

Fourth Embodiment

Figure 9:
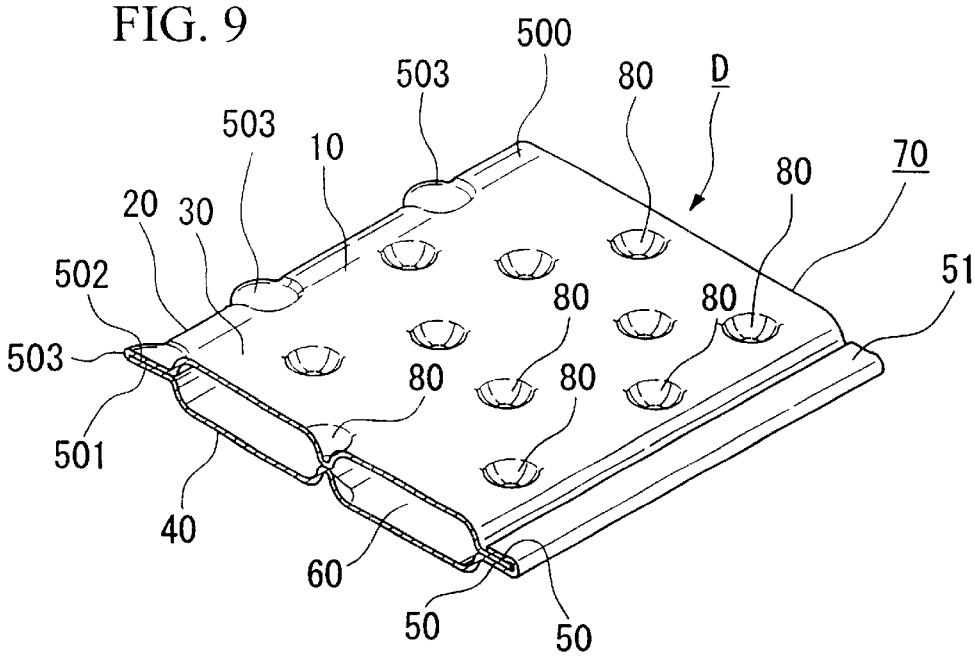
FIG. 9 is a view showing a fourth embodiment o f the present invention that is a perspective view showing another example of a heat exchanger tube.
Figure 10:
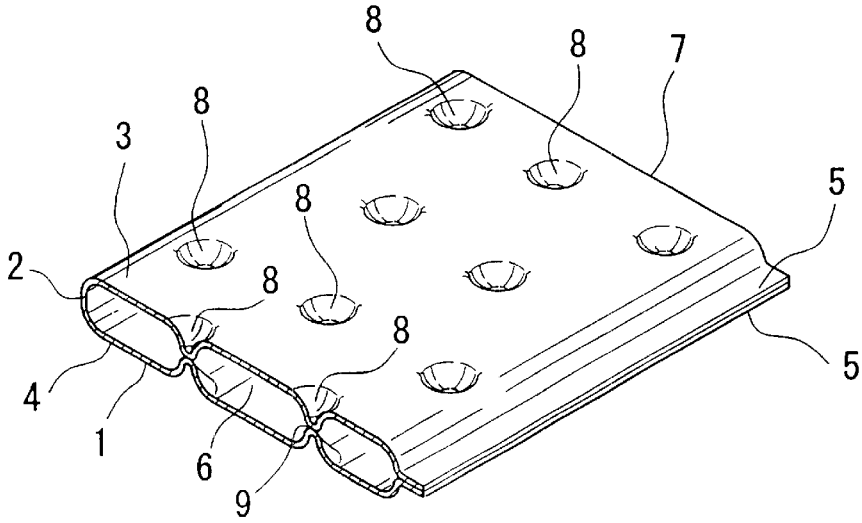
FIG. 10 PRIOR ART
FIG. 10 is a perspective view showing one example of a conventional heat exchanger tube.

FIG. 9 shows a fourth embodiment of a heat exchanger tube according to the present invention. In a heat exchanger tube D shown in FIG. 9, a band-shaped plate member 10 is folded with a fold 20 in a direction of its extension, and the folded portions 500, 500 of the wall portions 30 and 40 include a plurality of spring back prevention portions 503, 503 . . . welded to each other in contact surfaces 501 and 502.

In the heat exchanger tube D shown in FIG. 9, portions corresponding to the portions shown in FIGS. 1 to 8 respectively are denoted by the same reference numerals and the details thereof are omitted here.

In the heat exchanger tube D having the above-mentioned configuration, the spring back force that deforms the tube body 70 is locally added to the spring back prevention portions 503, 503 and the magnitude of the force due to the spring back which separates the opposite portions 30 and 40 are decreased.

According to the heat exchanger tube D shown in FIG. 9, the spring back effect is reduced by a simple reinforcement to deform the shape of a fold. Thus, reliable soldering can be performed while keeping the shape of the tube body and a higher pressure resistance can be imparted to the tube body.

Alternatively, the heat exchanger tubes A, B, and C shown in FIGS. 1, 3, 5, 7 and 8 may have a configuration in which the spring back prevention portions as shown in FIG. 9 can be provided on the folded portions of the band-shaped plate members.

By providing such spring back prevention portions, reliable soldering can be performed while maintaining the shape of the tube body and a higher pressure resistance can be imparted to the tube body.

The present invention exhibits the following effects.

As described above, according to the heat exchanger tube according to a first aspect, opposite wall portions are firmly connected to each other and a high pressure resistance can be imparted to the tube body.

According to the heat exchanger tube according to a second aspect, opposite wall portions are firmly connected to each other at a plurality of positions by the first bulging wall portions and a higher pressure resistance can be imparted to the tube body.

Further, since the plurality of first bulging wall portions agitate a fluid flowing through the interior of the tube body, a distribution of a fluid temperature in the plane vertical to the direction of the flow can be made uniform.

According to the heat exchanger tube according to a third aspect, the connection between the leading ends of the first bulging wall portions which connects opposite wall portions can be reinforced by a plurality of protrusion members and a high pressure resistance can be imparted to the tube body. Further, since the surface area of the inner surface of the tube body is increased, the thermal conductivities from a fluid to the tube body can be enhanced.

According to the heat exchanger tube according to a fourth aspect, the opposite wall portions can be linearly connected to each other by better soldering with the second extending portions and a high pressure resistance can be imparted to the tube body.

According to the heat exchanger tube according to a fifth aspect, the opposite wall portions can be linearly connected to each other by better soldering with the third extending portions and a high pressure resistance can be imparted to the tube body.

Further, since the both end portions of band-shaped plate members can be used as bulging wall portions as they are, the configuration of the tube body can be simplified without the need to provide bulging wall portions by bending and a seam of the plate member can be welded to the tube body and the pressure resistance can be further enhanced.

According to the heat exchanger tube according to a sixth aspect, a fluid flowing in the interior of the tube body can freely flow through the interior of the tube body. Therefore, a difference between fluid temperatures between passages divided by extending portions is prevented.

According to the heat exchanger tube according to a seventh aspect, since the spring back force for deforming the tube body is reduced, reliable soldering can be performed while keeping the shape of the tube body, and a higher pressure resistance can be imparted to the tube body.

According to the heat exchanger tube according to an eighth aspect, the connections at the connecting end portions are reinforced with a fastening plate member, and a higher pressure resistance can be imparted to the tube body.

According to the heat exchanger tube according to a ninth aspect, by a simple reinforcement to deform the shape of a fold, reliable soldering can be performed while maintaining the shape of the tube body, and a higher pressure resistance can be imparted to the tube body.

What is claimed is:

1. A heat exchanger comprising:

a tube body having first and second wall portions which oppose each other forming an interior defining a fluid flow passage for flow of a fluid therethrough, each of said first and second wall portions having inner and outer surfaces defining heat entrance and exit surfaces of the fluid;

a plurality of bulging wall portions formed in said first wall portion of said tube body, each of said plurality of bulging wall portions have a curved cylindrical side wall portion beginning at an intersection thereof with said first wall portion and tapering in diameter to a flat leading end;

a plurality of triangular-shaped cross-section protrusion members protruding inwardly into said interior of said tube body from portions of said inner surfaces of said first and second wall portions, each of said plurality of triangular-shaped cross-section protrusion members extending linearly in a direction of a length of said tube body, each of said plurality of triangular-shaped cross-section protrusion members on said portions of said inner surfaces of said first wall portion being located at least on said flat leading ends of each of said plurality of bulging wall portions, and each of said plurality of triangular-shaped cross-section protrusion members being immediately adjacent to another one of said plurality of triangular-shaped cross-section protrusion members, but separated therefrom by each of a plurality of triangular-shaped cross-section recesses;

wherein each of said plurality of bulging wall portions formed in said first wall portion have said flat leading end thereof extending toward a direction of said second wall portion so that each of said plurality of triangular-shaped cross-section protrusion members on at least said inner surfaces of said flat leading ends of each of said plurality of bulging wall portions matingly fit and are fixedly connected to each of said plurality of triangular-shaped cross-section recesses on said inner surface of said second wall portion, thereby providing more surface area for a better fit and stronger connection of said flat leading end portions of each of said plurality of bowl-shaped bulging wall portions.

2. The heat exchanger tube of claim 1, further comprising a fold between said first wall portion and said second wall portion, said fold integrally connecting said first and second wall portions to each other.

3. The heat exchanger tube of claim 2, wherein both said first wall and second wall portions include a flange extending from at least one end thereof such that said flange on said second wall portion is approximately twice as long as said flange on said first wall portion and said flange on said second wall portion is folded in a U-shaped around said flange on said first wall portion in order to connect said first wall portion to said second wall portion.

4. The heat exchanger tube of claim 1, wherein both said first wall and second wall portions include a flange extending from at least end thereof such that said flange on said second wall portion is approximately twice as long as said flange on said first wall portion and said flange on said second wall portion is folded in a U-shaped around said flange on said first wall portion in order to connect said first wall portion to said second wall portion.

5. The heat exchanger tube of claim 1, wherein both said first wall and second wall portions include first and second flanges extending from first and second ends thereof, respectively, such that said first and second flanges on said second wall portion are each approximately twice as long as said first and second flanges, respectively, on said first wall portion and said first and second flanges on said second wall portion are folded in a U-shaped around said first and second flange, respectively, on said first wall portion in order to connect said first wall portion to said second wall portion.

6. A heat exchanger comprising:

a tube body having first and second wall portions which oppose each other forming an interior defining a fluid flow passage for flow of a fluid therethrough, each of said first and second wall portions having inner and outer surfaces defining heat entrance and exit surfaces of the fluid;

a plurality of bulging wall portions formed in said second wall portion of said tube body, each of said plurality of bulging wall portions have a curved cylindrical side wall portion beginning at an intersection thereof with said second wall portion and tapering in diameter to a flat leading end;

a plurality of triangular-shaped cross-section protrusion members protruding inwardly into said interior of said tube body from portions of said inner surfaces of said first and second wall portions, each of said plurality of triangular-shaped cross-section protrusion members extending linearly in a direction of a length of said tube body, each of said plurality of triangular-shaped cross-section protrusion members on said portions of said inner surfaces of said second wall portion being located at least on said flat leading ends of each of said plurality of bulging wall portions, and each of said plurality of triangular-shaped cross-section protrusion members being immediately adjacent to another one of said plurality of triangular-shaped cross-section protrusion members, but separated therefrom by each of a plurality of triangular-shaped cross-section recesses;

wherein each of said plurality of bulging wall portions formed in said second wall portion have said flat leading end thereof extending toward a direction of said first wall portion so that each of said plurality of triangular-shaped cross-section protrusion members on at least said inner surfaces of said flat leading ends of each of said plurality of bulging wall portions matingly fit and are fixedly connected to each of said plurality of triangular-shaped cross-section recesses on said inner surface of said second wall portion, thereby providing more surface area for a better fit and stronger connection of said flat leading end portions of each of said plurality of bowl-shaped bulging wall portions.

7. The heat exchanger tube of claim 6, further comprising a fold between said first wall portion and said second wall portion, said fold integrally connecting said first and second wall portions to each other.

8. The heat exchanger tube of claim 7, wherein both said first wall and second wall portions include a flange extending from at least one end thereof such that said flange on said second wall portion is approximately twice as long as said flange on said first wall portion and said flange on said second wall portion is folded in a U-shaped around said flange on said first wall portion in order to connect said first wall portion to said second wall portion.

9. The heat exchanger tube of claim 6, wherein both said first wall and second wall portions include a flange extending from at least end thereof such that said flange on said second wall portion is approximately twice as long as said flange on said first wall portion and said flange on said second wall portion is folded in a U-shaped around said flange on said first wall portion in order to connect said first wall portion to said second wall portion.

10. The heat exchanger tube of claim 6, wherein both said first wall and second wall portions include first and second flanges extending from first and second ends thereof, respectively, such that said first and second flanges on said second wall portion are each approximately twice as long as said first and second flanges, respectively, on said first wall portion and said first and second flanges on said second wall portion are folded in a U-shaped around said first and second flange, respectively, on said first wall portion in order to connect said first wall portion to said second wall portion.

11. A heat exchanger comprising:

a tube body having first and second wall portions which oppose each other forming an interior defining a fluid flow passage for flow of a fluid therethrough, each of said first and second wall portions having inner and outer surfaces defining heat entrance and exit surfaces of the fluid;

a plurality of bulging wall portions formed in both of said first and second wall portions of said tube body, each of said plurality of bulging wall portions have a curved cylindrical side wall portion beginning at an intersection thereof with said first and second wall portions and tapering in diameter to a flat leading end;

a plurality of triangular-shaped cross-section protrusion members protruding inwardly into said interior of said tube body from portions of said inner surfaces of said first and second wall portions, each of said plurality of triangular-shaped cross-section protrusion members extending linearly in a direction of a length of said tube body, each of said plurality of triangular-shaped cross-section protrusion members on said portions of said inner surfaces of said first and second wall portions being located at least on said flat leading ends of each of said plurality of bulging wall portions, and each of said plurality of triangular-shaped cross-section protrusion members being immediately adjacent to another one of said plurality of triangular-shaped cross-section protrusion members, but separated therefrom by each of a plurality of triangular-shaped cross-section recesses;

wherein each of said plurality of bulging wall portions formed in said first and second wall portions have said flat leading end thereof extending toward a direction of said second and first wall portions, respectively, so that each of said plurality of triangular-shaped cross-section protrusion members on at least said inner surfaces of said flat leading ends of each of said plurality of bulging wall portions in said first and second wall portions matingly fit and are fixedly connected to each of said plurality of triangular-shaped cross-section recesses on said inner surface of said second and first wall portions, respectively, thereby providing more surface area for a better fit and stronger connection of said flat leading end portions of each of said plurality of bowl-shaped bulging wall portions.

12. The heat exchanger tube of claim 11, further comprising a fold between said first wall portion and said second wall portion, said fold integrally connecting said first and second wall portions to each other.

13. The heat exchanger tube of claim 12, wherein both said first wall and second wall portions include a flange extending from at least one end thereof such that said flange on said second wall portion is approximately twice as long as said flange on said first wall portion and said flange on said second wall portion is folded in a U-shaped around said flange on said first wall portion in order to connect said first wall portion to said second wall portion.

14. The heat exchanger tube of claim 11, wherein both said first wall and second wall portions include a flange extending from at least end thereof such that said flange on said second wall portion is approximately twice as long as said flange on said first wall portion and said flange on said second wall portion is folded in a U-shaped around said flange on said first wall portion in order to connect said first wall portion to said second wall portion.

15. The heat exchanger tube of claim 11, wherein both said first wall and second wall portions include first and second flanges extending from first and second ends thereof, respectively, such that said first and second flanges on said second wall portion are each approximately twice as long as said first and second flanges, respectively, on said first wall portion and said first and second flanges on said second wall portion are folded in a U-shaped around said first and second flange, respectively, on said first wall portion in order to connect said first wall portion to said second wall portion.

* * * * *